US009366997B2

(12) United States Patent
Uno et al.

(10) Patent No.: US 9,366,997 B2
(45) Date of Patent: Jun. 14, 2016

(54) IMAGE FORMING APPARATUS HAVING CLEANING SECTION FOR REMOVING RESIDUAL TONER ON INTERMEDIATE TRANSFER BELT

(71) Applicant: KYOCERA Document Solutions Inc., Osaka (JP)

(72) Inventors: Koji Uno, Osaka (JP); Masafumi Hashimura, Osaka (JP); Yasuhiro Michishita, Osaka (JP); Tetsuya Toichi, Osaka (JP); Satoshi Uemura, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 5 days.

(21) Appl. No.: 14/655,323

(22) PCT Filed: Oct. 1, 2014

(86) PCT No.: PCT/JP2014/076288
§ 371 (c)(1),
(2) Date: Jun. 24, 2015

(87) PCT Pub. No.: WO2015/064285
PCT Pub. Date: Jul. 5, 2015

(65) Prior Publication Data

US 2015/0346642 A1 Dec. 3, 2015

(30) Foreign Application Priority Data

Oct. 31, 2013 (JP) ..... 2013-227767

(51) Int. Cl.
*G03G 15/16* (2006.01)
*G03G 21/10* (2006.01)

(52) U.S. Cl.
CPC ..... *G03G 15/161* (2013.01); *G03G 15/16* (2013.01); *G03G 21/10* (2013.01); *G03G 2215/0132* (2013.01)

(58) Field of Classification Search
None
See application file for complete search history.

(56) References Cited

U.S. PATENT DOCUMENTS 8,027,612 B2 * 9/2011 Soda ..... G03G 21/0064 399/101
9,037,035 B2 5/2015 Nakai et al.
(Continued)

FOREIGN PATENT DOCUMENTS

JP 2001-282007 A 10/2001
JP 2005-250411 A 9/2005
(Continued)

OTHER PUBLICATIONS

International Search Report dated Dec. 16, 2014 issued in corresponding PCT/JP2014/076288 application (pp. 1-3).

*Primary Examiner* — David Gray
*Assistant Examiner* — Geoffrey T Evans

(57) ABSTRACT

An image forming apparatus (1) includes an image forming section (12), an intermediate transfer belt (125), a drive roller (125A), a secondary transfer roller (210), a brush section (80), a cleaning device (70), a power supply device (81), and a ground portion (82). The brush section (80) is disposed at a location downstream of the secondary transfer roller (210) in a direction of travel of the intermediate transfer belt (125) and facing the drive roller (125A) with the intermediate transfer belt (125) in between. A potential difference is applied between the brush section (80) and the secondary transfer roller (210) by the power supply device (81) and the ground portion (82), so that an electric current having the same polarity as a normal charge polarity flows from the brush section (80) through the drive roller (125A) to the secondary transfer roller (210).

4 Claims, 7 Drawing Sheets

(56) References Cited

U.S. PATENT DOCUMENTS

2011/0150532 A1* 6/2011 Shimura ..... G03G 15/0233 399/175
2011/0293306 A1* 12/2011 Matsumoto ..... G03G 15/1605 399/66
2012/0027453 A1* 2/2012 Watanabe ..... G03G 15/161 399/101
2012/0051785 A1 3/2012 Nakai et al.
2013/0108313 A1* 5/2013 Katagiri ..... G03G 15/161 399/101
2013/0315616 A1* 11/2013 Ohno ..... G03G 21/0047 399/101
2014/0105626 A1* 4/2014 Ohno ..... G03G 15/1605 399/66
2014/0147146 A1* 5/2014 Kobayashi ..... G03G 15/161 399/66
2015/0093143 A1* 4/2015 Funatani ..... G03G 21/12 399/101

FOREIGN PATENT DOCUMENTS

JP 2009-128459 A 6/2009
JP 2009-134214 A 6/2009
JP 2012-053163 A 3/2012

* cited by examiner

Fig.6

| | EXAMPLE | COMPARATIVE EXAMPLE 1 | COMPARATIVE EXAMPLE 2 |
|---|---|---|---|
| CLEANING PERFORMANCE | ○ | × | × |
| NUMBER OF THIN PAPER SHEETS SEPARATED | 10 OR MORE | 9 OR LESS | 9 OR LESS |

IMAGE FORMING APPARATUS HAVING CLEANING SECTION FOR REMOVING RESIDUAL TONER ON INTERMEDIATE TRANSFER BELT

TECHNICAL FIELD

The present invention relates to image forming apparatuses and particularly relates to a technique for removing residual toner on the peripheral surface of an intermediate transfer belt of an image forming apparatus.

BACKGROUND ART

There is known an image forming apparatus in which image forming units for different colors are arranged side by side at locations facing an intermediate transfer belt and which is configured to form a multicolor image by superposing toner images of different colors on the intermediate transfer belt and then transfer the multicolor image to a recording paper sheet with a secondary transfer roller to form an image on the recording paper sheet. This image forming apparatus is provided with a cleaning section for electrically attracting residual toner remaining on the outer peripheral surface of the intermediate transfer belt after the transfer of the multicolor image to the recording paper sheet to collect the residual toner.

However, because electrified charges on the residual toner are not uniform, it may be difficult to sufficiently collect the residual toner using only the aforementioned cleaning section. As a solution to this, there is known a technique for subjecting the residual toner to a pretreatment prior to the collection of the residual toner in the cleaning section. Patent Literature 1 discloses a technique for providing a grounded pretreatment member upstream of a cleaning section in a direction of travel of an intermediate transfer belt to adjust the amount of electrified charges on residual toner and thus increasing the collectability of the residual toner in the cleaning section.

CITATION LIST

Patent Literature

Patent Literature 1: JP-A-2005-250411

SUMMARY OF INVENTION

Technical Problem

However, the technique disclosed in the above Patent Literature 1 has poor ability to adjust the amount of electrified charges on residual toner and, if a large amount of residual toner is produced, it cannot sufficiently collect the residual toner.

Furthermore, in image forming apparatuses, there may be cases where a failure of separation of a recording paper sheet occurs in which after a multicolor image is transferred to the recording paper sheet by a secondary transfer roller, the recording paper sheet sticks to the intermediate transfer belt. In some conventional image forming apparatuses, a separating needle is provided for separating a recording paper sheet by attracting the recording paper sheet using charges of opposite polarity to electrified charges on the recording paper sheet but the recording paper sheet may not be able to be well separated simply by using the separating needle. It is conceivable to provide, in addition to the separating needle, another configuration for separating the recording paper sheet. In this case, however, a problem arises in that the structure of the image forming apparatus becomes complicated.

The present invention has been made in view of the foregoing points and an object thereof is to provide an image forming apparatus that can, with a simple structure, sufficiently collect residual toner remaining on the outer peripheral surface of the intermediate transfer belt and separate the recording paper sheet from the intermediate transfer belt.

Solution to Problem

An image forming apparatus according to one aspect of the present invention includes an image forming section, an intermediate transfer belt, a drive roller, a transfer roller, a charging member, a cleaning section, and a potential difference applying section. The image forming section is configured to form a toner image. The intermediate transfer belt is configured to allow the toner image to be transferred to an outer peripheral surface thereof from the image forming section. The drive roller is configured to drive the intermediate transfer belt into rotation. The transfer roller is disposed at a location facing the drive roller with the intermediate transfer belt in between. The charging member is disposed at a location downstream of the transfer roller in a direction of travel of the intermediate transfer belt and facing the drive roller with the intermediate transfer belt in between and configured to charge residual toner remaining on the outer peripheral surface of the intermediate transfer belt to a normal charge polarity. The cleaning section is disposed downstream of the charging member in the direction of travel of the intermediate transfer belt and configured to electrically attract the residual toner remaining on the outer peripheral surface of the intermediate transfer belt to collect the residual toner. The potential difference applying section is configured to apply a potential difference between the charging member and the transfer roller to generate an electric current flowing from the charging member through the drive roller to the transfer roller and having the same polarity as the normal charge polarity.

Advantageous Effects of Invention

The image forming apparatus according to the one aspect of the present invention can, with a simple structure, sufficiently collect residual toner remaining on the outer peripheral surface of the intermediate transfer belt and separate the recording paper sheet from the intermediate transfer belt.

BRIEF DESCRIPTION OF DRAWINGS

FIG. 6 is a chart showing results of an experiment for confirming the cleaning performance and the performance of separating a recording paper sheet in the image forming apparatus according to the one embodiment of the present invention.

DESCRIPTION OF EMBODIMENTS

Figure 1:
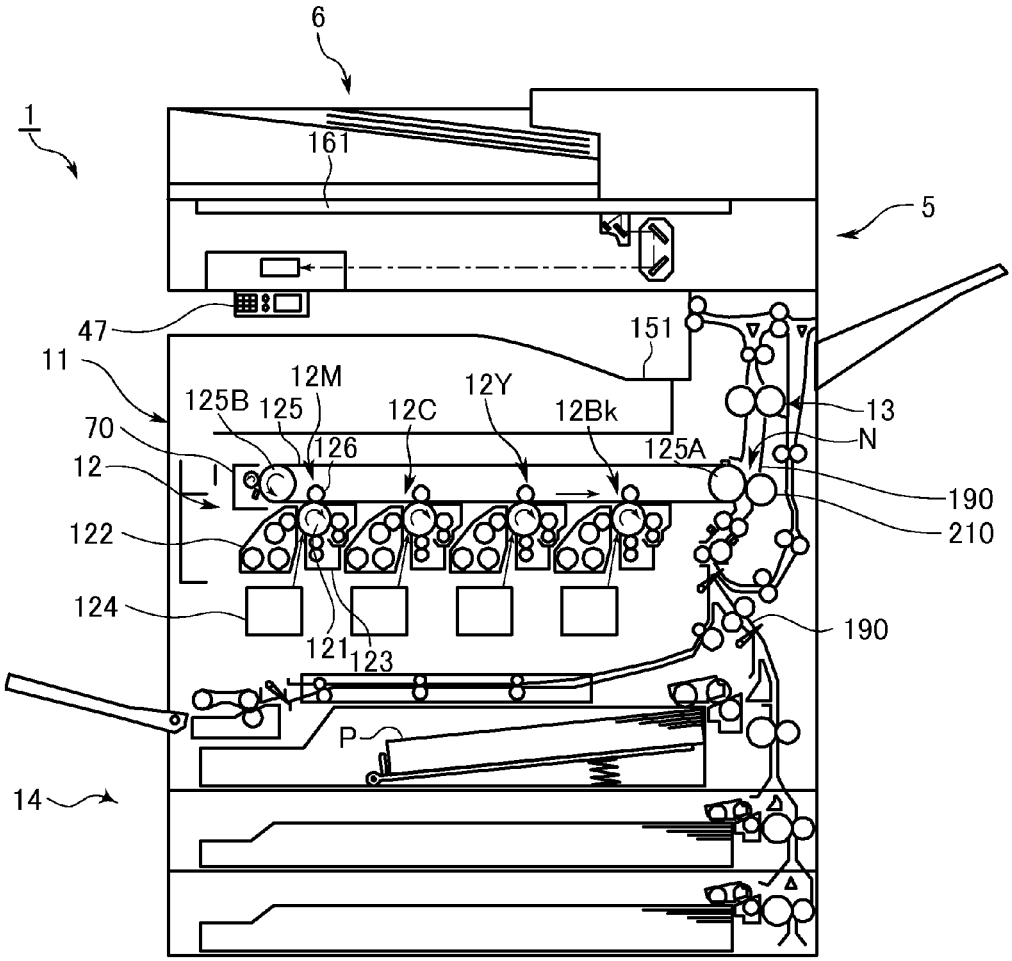
FIG. 1 is a front cross-sectional view showing the structure of an image forming apparatus according to one embodiment of the present invention.

Hereinafter, a description will be given of an image forming apparatus according to one embodiment of the present invention with reference to the drawings. FIG. 1 is a front cross-sectional view showing the structure of the image forming apparatus according to the one embodiment of the present invention.

The image forming apparatus 1 according to the one embodiment of the present invention is a multifunction peripheral having multiple functions including, for example, a copy function, a print function, a scan function, and a facsimile function. The image forming apparatus 1 is made up so that an apparatus body 11 thereof includes an operating section 47, an image forming section 12, a fixing section 13, a sheet feed section 14, a document feed section 6, an image reading section 5, and so on.

The operating section 47 is configured to receive, from an operator, commands for various types of operations and processing executable by the image forming apparatus 1, such as a command to perform an image forming operation and a command to perform a document reading operation.

When the image forming apparatus 1 performs the document reading operation, the image reading section 5 optically reads an image of an original document being fed from the document feed section 6 or an image of an original document placed on an original glass plate 161 to generate image data. The image data generated by the image reading section 5 is stored on an internal HDD, a network-connected computer or the like.

When the image forming apparatus 1 performs the image forming operation, the image forming section 12 forms a toner image on a recording paper sheet P serving as a recording medium fed from the sheet feed section 14, based on image data generated by the document reading operation, image data received from a network-connected computer, image data stored on the internal HDD or other image data. Each of image forming units 12M, 12C, 12Y, and 12Bk of the image forming section 12 includes a photosensitive drum 121, a developing device 122 operable to supply toner to the photosensitive drum 121, a toner cartridge (not shown) for holding the toner, a charging device 123, an exposure device 124, and a primary transfer roller 126.

In performing color printing, the image forming unit 12M for magenta, the image forming unit 12C for cyan, the image forming unit 12Y for yellow, and the image forming unit 12Bk for black in the image forming section 12 form respective toner images on their respective photosensitive drums 121 through charging, exposure, and developing processes based on respective images of respective different color components constituting the image data and then allow their respective primary transfer rollers 126 to transfer the toner images to an intermediate transfer belt 125 mounted around a drive roller 125A and a driven roller 125B.

The intermediate transfer belt 125 has an outer peripheral surface set as an image carrying surface to which a toner image is to be transferred, and is configured to be driven by the drive roller 125A while engaging against the peripheral surfaces of the photosensitive drums 121. The intermediate transfer belt 125 is configured to travel in an endless path between the drive roller 125A and the driven roller 125B while synchronizing with each photosensitive drum 121.

The toner images of different colors transferred to the intermediate transfer belt 125 are superposed each other on the intermediate transfer belt 125 by controlling their transfer timings, resulting in a multicolor toner image. A secondary transfer roller 210 is configured to transfer the multicolor toner image formed on the surface of the intermediate transfer belt 125, at a nip N between the secondary transfer roller 210 and the drive roller 125A with the intermediate transfer belt 125 in between, to a recording paper sheet P conveyed from the sheet feed section 14 along a conveyance path 190. Thereafter, the fixing section 13 fixes the toner image on the recording paper sheet P by the application of heat and pressure. The recording paper sheet P having a multicolor image fixed thereon by the completion of the fixation treatment is discharged to a paper output tray 151.

A cleaning device (cleaning section) 70 is provided at a portion of the intermediate transfer belt 125 mounted around the driven roller 125B. The cleaning device 70 is configured to collect toner remaining on the outer peripheral surface of the intermediate transfer belt 125.

Figure 2:
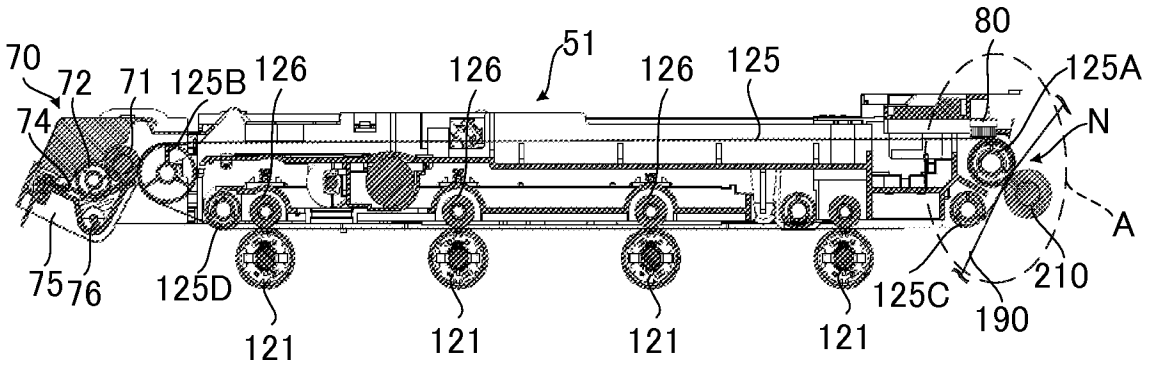
FIG. 2 is a side cross-sectional view showing a mechanism around an intermediate transfer belt in the one embodiment of the present invention.
Figure 3:
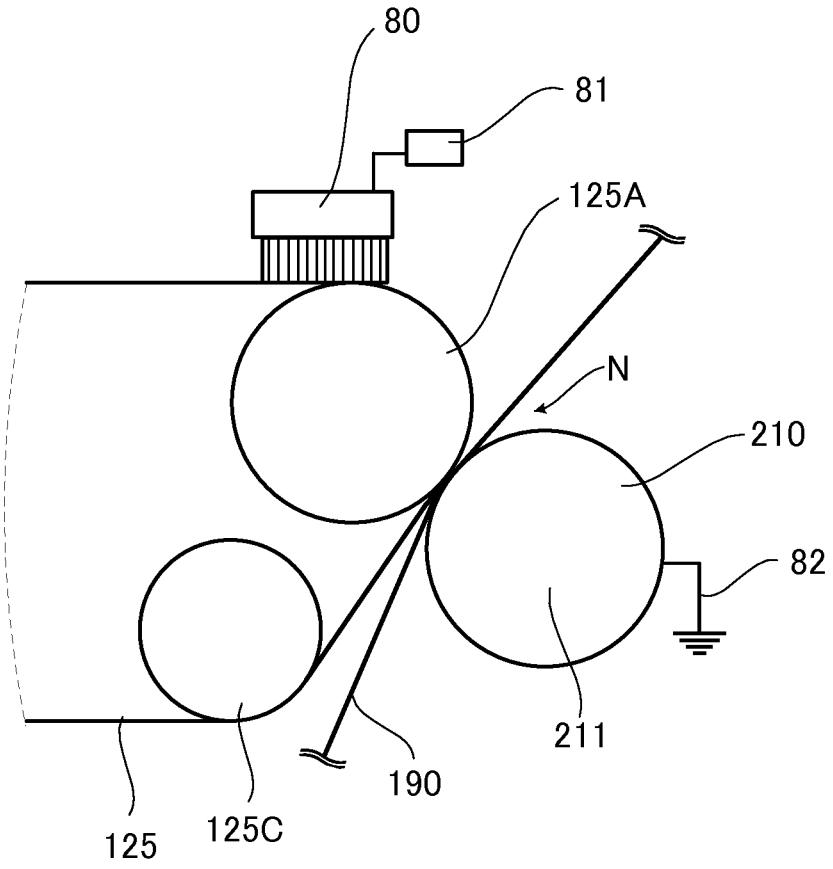
FIG. 3 is an enlarged side cross-sectional view of portion A of FIG. 2.

Next, a description will be given of a mechanism around the intermediate transfer belt 125. FIG. 2 is a side cross-sectional view showing the mechanism around the intermediate transfer belt 125. FIG. 3 is an enlarged side cross-sectional view of portion A of FIG. 2.

The drive roller 125A is rotatably supported at one end of a casing 51 and the driven roller 125B is rotatably supported at the other end thereof. Furthermore, the casing 51 contains, in addition to the drive roller 125A and the driven roller 125B, tension rollers 125C and 125D, the primary transfer rollers 126 for different colors, the cleaning device 70, the brush section (charging member) 80, and so on.

The cleaning device 70 is disposed downstream of the brush section 80 to be described later in the direction of travel of the intermediate transfer belt 125, is in contact with the outer peripheral surface of the portion of the intermediate transfer belt 125 mounted around the driven roller 125B, and is configured to electrically attract toner remaining on the outer peripheral surface thereof to collect the toner.

The cleaning device 70 includes a fur brush 71, a collecting roller 72, a cleaning blade 74, a toner reservoir 75, and a toner conveying screw 76.

The fur brush 71 is in contact, where the intermediate transfer belt 125 is mounted around the driven roller 125B, with the outer peripheral surface of the intermediate transfer belt 125 and is configured to electrically attract toner remaining on the outer peripheral surface thereof to collect the toner. The fur brush 71 is formed, for example, so that brush bristles made of resinous filaments are wrapped around the entire periphery of a rotary shaft. The rotary shaft of the fur brush 71 extends in a direction along a rotary shaft of the driven roller 125B and is journaled to the casing 51.

The collecting roller 72 is in contact with the surface of the fur brush 71 and is configured to electrically attract the toner collected by the fur brush 71 to collect it. A rotary shaft of the collecting roller 72 extends in a direction along the rotary shaft of the fur brush 71 and is journaled to the casing 51.

The cleaning blade 74 is formed of a flat plate-like member and extends in a direction along the rotary shaft of the collecting roller 72. The cleaning blade 74 is attached to the casing 51 so that its tip end is in contact with the surface of the collecting roller 72. The cleaning blade 74 is configured to scrape the toner collected by the collecting roller 72 from the surface of the collecting roller 72. The scraped toner drops into the toner reservoir 75 and is accumulated therein.

The toner reservoir 75 is provided with the toner conveying screw 76. The toner conveying screw 76 extends in the direction along the rotary shaft of the collecting roller 72 and a rotary shaft thereof is journaled to the casing 51. The peripheral surface of the rotary shaft of the toner conveying screw 76 is provided with a spiral toner conveying blade (not shown). The toner in the toner reservoir 75 is collected to a predetermined location in the direction along the rotary shaft by the toner conveying blade. In this manner, the residual toner on the outer peripheral surface of the intermediate transfer belt 125 is collected.

Next, a description will be given of the brush section 80. The brush section 80 is disposed at a location upstream of the cleaning device 70 in the direction of travel of the intermediate transfer belt 125, downstream of the secondary transfer roller 210 in the direction of travel of the intermediate transfer belt 125, and facing the drive roller 125A with the intermediate transfer belt 125 in between. The brush section 80 is a stationary brush and is disposed at the above location so that its brush surface is in contact with the outer peripheral surface of the intermediate transfer belt 125.

As shown in FIG. 3, the brush section 80 is connected to a power supply device 81. During the image forming operation, the brush section 80 is supplied with a bias from the power supply device 81. Meanwhile, electrified charges on residual toner remaining on the outer peripheral surface of the intermediate transfer belt 125 after the transfer of a multicolor image to the recording paper sheet P are not uniform. For example, owing to separation discharge or the like caused when the recording paper sheet P separates from the intermediate transfer belt 125, there exists residual toner charged to opposite polarity (minus in this embodiment) to the normal charge polarity (plus in this embodiment). When a bias of the same polarity as the normal charge polarity is applied from the power supply device 81 to the brush section 80, the residual toner at a location facing the brush section 80 is charged to the normal charge polarity. Thus, the electrified charges on the residual toner can be made uniform to increase the collectability of the residual toner in the cleaning device 70.

The secondary transfer roller 210 is disposed at a location facing the drive roller 125A with the intermediate transfer belt 125 in between. The secondary transfer roller 210 has a rotary shaft 211 extending in the same direction as the rotary shaft of the driven roller 125B and is configured to rotate in the opposite direction to the direction of rotation of the driven roller 125B with the rotary shaft 211 as the center of rotation.

The secondary transfer roller 210 includes a ground portion 82 and is electrically grounded at the ground portion 82 by a frame ground or the like. Thus, a potential difference is generated between the brush section 80 connected to the power supply device 81 and biased with the same polarity as the normal charge polarity and the secondary transfer roller 210. As will hereinafter be described in detail, this potential difference generates an electric current flowing from the brush section 80 through the drive roller 125A to the secondary transfer roller 210 and having the same polarity as the normal charge polarity, so that charges of the same polarity as the normal charge polarity are applied to residual toner located on the intermediate transfer belt 125 between the brush section 80 and the secondary transfer roller 210.

Figure 4:
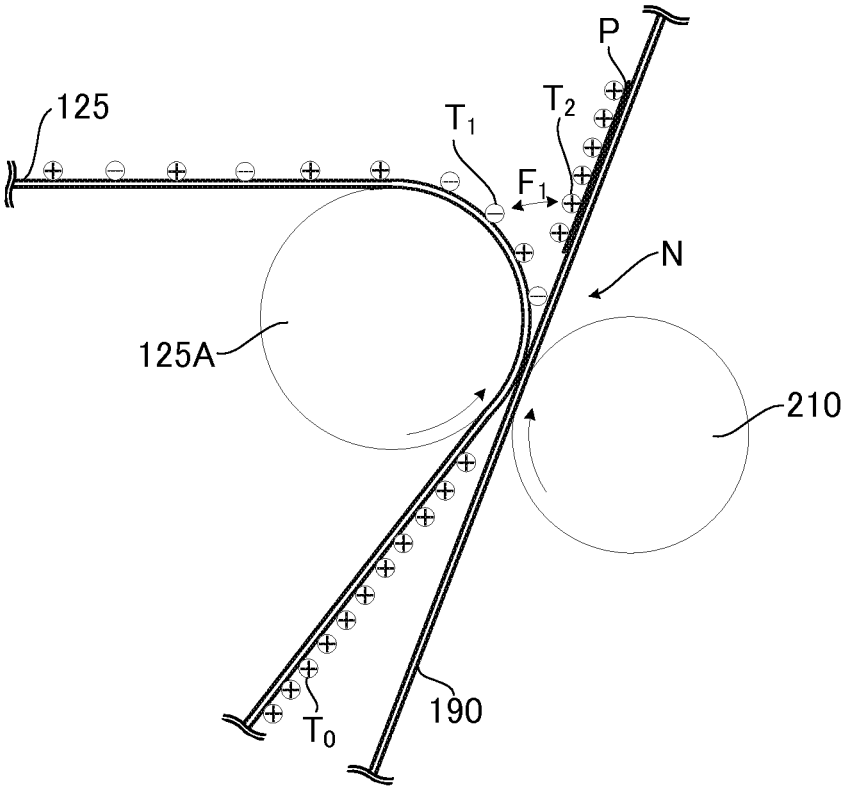
FIG. 4 is a view schematically showing charging of toner and a recording paper sheet around a drive roller in a general image forming apparatus.

Next, a description will be given of charging of toner and a recording paper sheet P around the drive roller 125A. The description thereof will be directed first to a general image forming apparatus which is not provided with the brush section 80, the power supply device 81, and the ground portion 82. FIG. 4 is a view schematically showing charging of toner and a recording paper sheet P around the drive roller 125A in the general image forming apparatus.

As shown in FIG. 4, toner entering the nip N formed by the drive roller 125A and the secondary transfer roller 210 is charged to a normal charge polarity (plus) as shown at $T_0$ in the figure and the surface of the transfer belt carrying the toner is also charged to the plus polarity. When the toner is transferred to the recording paper sheet P conveyed along the conveyance path 190 from the sheet feed section 14 and the recording paper sheet P then separates from the intermediate transfer belt 125, separation discharge occurs. Owing to this separation discharge, the surface of the recording paper sheet P is charged to the plus polarity as shown at $T_2$ in the figure. On the other hand, part of residual toner remaining on the intermediate transfer belt 125 after the transfer to the recording paper sheet P is charged, by the above separation discharge, to a minus polarity which is an opposite polarity to the normal charge polarity, as shown at $T_1$ in the figure. As a result, the surface of the intermediate transfer belt 125 carrying this part of residual toner is also charged to the minus polarity.

Since, as described just above, the polarity (plus) of the surface of the recording paper sheet P after the transfer is opposite to the polarity (minus) of the surface of the intermediate transfer belt 125 after the transfer, an electrostatic attraction $F_1$ occurs between the recording paper sheet P and the intermediate transfer belt 125. It can be considered that, consequently, a separation failure occurs in which the recording paper sheet P is not separated from the transfer belt 125 but sticks to the intermediate transfer belt 125.

Figure 5:
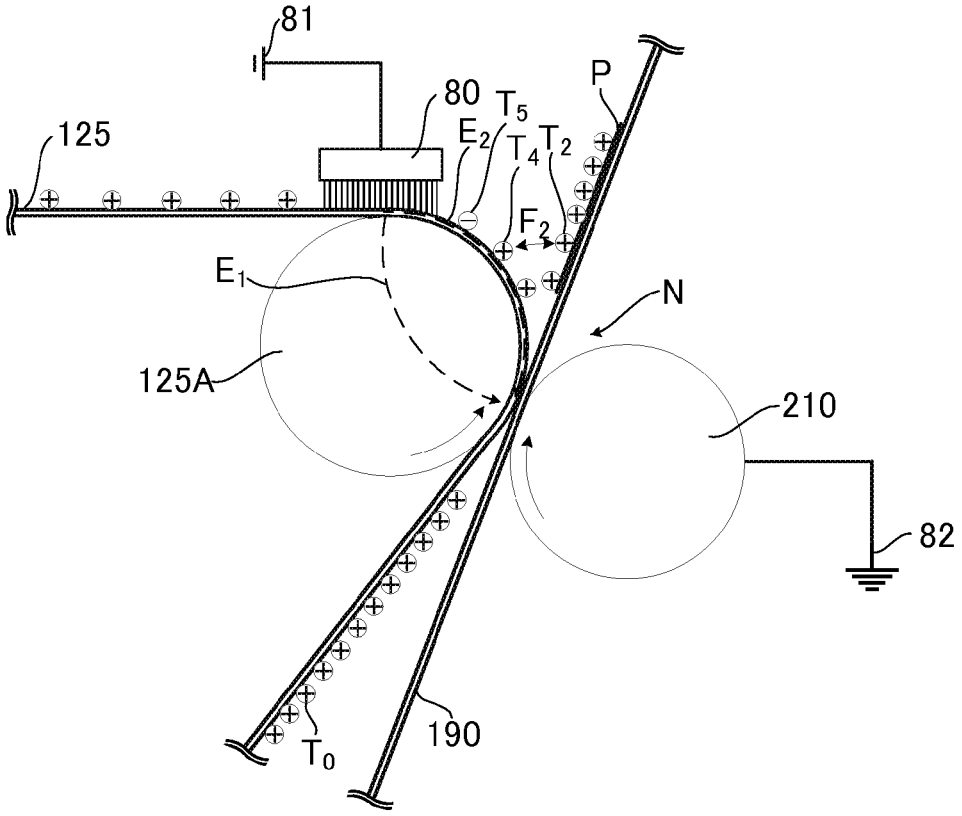
FIG. 5 is a view schematically showing charging of toner and a recording paper sheet around a drive roller in the one embodiment of the present invention.

The description will next be directed to the case of this embodiment. FIG. 5 is a view schematically showing charging of toner and a recording paper sheet P around the drive roller 125A in this embodiment.

In the image forming apparatus 1 according to this embodiment, the power supply device 81 and the ground portion 82 function as a potential difference applying section configured to apply a potential difference between the brush section 80 and the secondary transfer roller 210. Owing to a potential difference applied by the potential difference applying section, an electric current ($E_1$, $E_2$) is generated which flows from the brush section 80 through the drive roller 125A to the secondary transfer roller 210 and has the same polarity (plus) as the normal charge polarity. This electric current flow follows two courses. The first course is a course ($E_1$) of electric current passing from the brush section 80 through the intermediate transfer belt 125 into the drive roller 125A and then reaching the secondary transfer roller 210. The second course is a course ($E_2$) of electric current flowing from the brush section 80 along the surface of the intermediate transfer belt 125 and then reaching the secondary transfer roller 210. Out of the two courses, the second course $E_2$ of electric current functions to apply charges of the same polarity as the normal charge polarity to residual toner located on the intermediate transfer belt 125 between the brush section 80 and the secondary transfer roller 210 and charged to the minus polarity opposite to the normal charge polarity, thereby charging the residual toner to the normal charge polarity. Thus, the residual toner is charged to the normal charge polarity as shown at $T_4$ in the figure, so that the surface of the intermediate transfer belt 125 carrying the residual toner is charged to the same polarity as the normal charge polarity. Since the polarity (plus) of the surface of the recording paper sheet P after the transfer is equal to the polarity (plus) of the surface of the intermediate transfer belt 125 after the transfer, a repulsion $F_2$ occurs between the recording paper sheet P and the intermediate transfer belt 125. As a result, the recording paper sheet P is separated well from the intermediate transfer belt 125.

Furthermore, as shown at $T_5$ in the figure, the residual toner located on the intermediate transfer belt 125 between the brush section 80 and the secondary transfer roller 210 still contains partial residual toner charged to the minus polarity opposite to the normal charge polarity even if charges are applied on the course $E_2$ of electric current. When such partial residual toner reaches a location facing the brush section 80, it is electrically attracted by the brush section 80 to which a bias of the same polarity as the normal charge polarity is applied, so that charges of the same polarity as the normal charge polarity are applied to the partial residual toner. When charged to the same polarity as the normal charge polarity by application of charges of the same polarity as the normal charge polarity, the residual toner is ejected from the brush section 80. Thus, the electrified charges on the residual toner can be made uniform to increase the collectability of the residual toner in the cleaning device 70.

<Experiment>

The inventors performed an experiment for confirming the cleaning performance and the performance of separating a recording paper sheet P in the image forming apparatus 1 according to this embodiment. In confirming the cleaning performance, high-resistivity paper sheets were used for double-sided printing at a high coverage rate and it was determined whether or not residual toner was found downstream of the cleaning device 70 in the direction of travel of the intermediate transfer belt 125. In confirming the performance of separating a recording paper sheet P, printing was performed 20 times using thin paper sheets (52 g/m$^2$) and the number of sheets separated from the intermediate transfer belt 125 was determined.

The following shows the conditions for the brush section 80, the intermediate transfer belt 125, the drive roller 125A, the secondary transfer roller 210, and so on used in this experiment.

(Brush Section 80)

Bristle length: 4.8 [mm], volume resistivity: 2E+7 to 2E+9 [Ω·cm], bristle fineness: 6.5 [d], density: 20±5 [KF/inch$^2$], and applied voltage: 3.2 [kV].

(Intermediate Transfer Belt 125)

Surface resistivity: 1E+10 to 1E+11 [Ω/sq.], volume resistivity: 1E+9 [Ω·cm], and thickness: 400 [μm].

(Drive Roller 125A)

Outside diameter: 24 [mm] and volume resistivity: 1E+7 [Ω·cm].

(Secondary Transfer Roller 210)

Outside diameter: 20 [mm] and volume resistivity: 1E+7 [Ω·cm].

In addition to the image forming apparatus 1 according to this embodiment, image forming apparatuses according to Comparative Examples 1 and 2 were subjected to the experiment for confirming the cleaning performance and the performance of separating a recording paper sheet P.

The image forming apparatus according to Comparative Example 1 is different from the image forming apparatus 1 in that the brush section 80 is disposed not at a location facing the drive roller 125A but just upstream of the cleaning device 70 and the brush section 80 is not connected to the power supply device 81 but electrically floated. The image forming apparatus according to Comparative Example 2 is different from the image forming apparatus 1 in that the brush section 80 is disposed not at a location facing the drive roller 125A but just upstream of the cleaning device 70 and the brush section 80 is not connected to the power supply device 81 but electrically grounded.

Experimental results are shown in FIG. 6. As shown in FIG. 6, whereas in the image forming apparatus 1 according to this embodiment (Example) no residual toner was found downstream of the cleaning device 70 in the direction of travel of the intermediate transfer belt 125, residual toner was found downstream of the cleaning device 70 in the image forming apparatuses according to Comparative Examples 1 and 2. Furthermore, whereas the number of thin paper sheets separated was ten or more in the image forming apparatus 1, it was nine or less in the image forming apparatuses according to Comparative Examples 1 and 2.

These experiment results show that the image forming apparatus 1 according to this embodiment can sufficiently collect residual toner remaining on the outer peripheral surface of the intermediate transfer belt 125 and separate the recording paper sheet P from the intermediate transfer belt 125.

<Modification>

The present invention is not limited to the configuration of the above embodiment and can be modified in various ways.

(1) Although in the above embodiment a description has been given of the case where the power supply device 81 is connected to the brush section 80 to apply a bias of the same polarity as the normal charge polarity to the brush section 80 and the secondary transfer roller 210 is electrically grounded, the present invention is not necessarily limited to this case. It is sufficient in the present invention to apply a potential difference between the brush section 80 and the secondary transfer roller 210 to generate an electric current flowing from the brush section 80 through the drive roller 125A to the secondary transfer roller 210 and having the same polarity as the normal charge polarity. Therefore, a configuration is also possible in which a power supply device is connected to the transfer roller 210 to apply a bias of opposite polarity to the normal charge polarity to the transfer roller 210 and the brush section 80 is electrically grounded. Also in the case where such a configuration is employed, an electric current is generated which flows from the brush section 80 through the drive roller 125A to the secondary transfer roller 210 and has the same polarity as the normal charge polarity.

Figure 7:
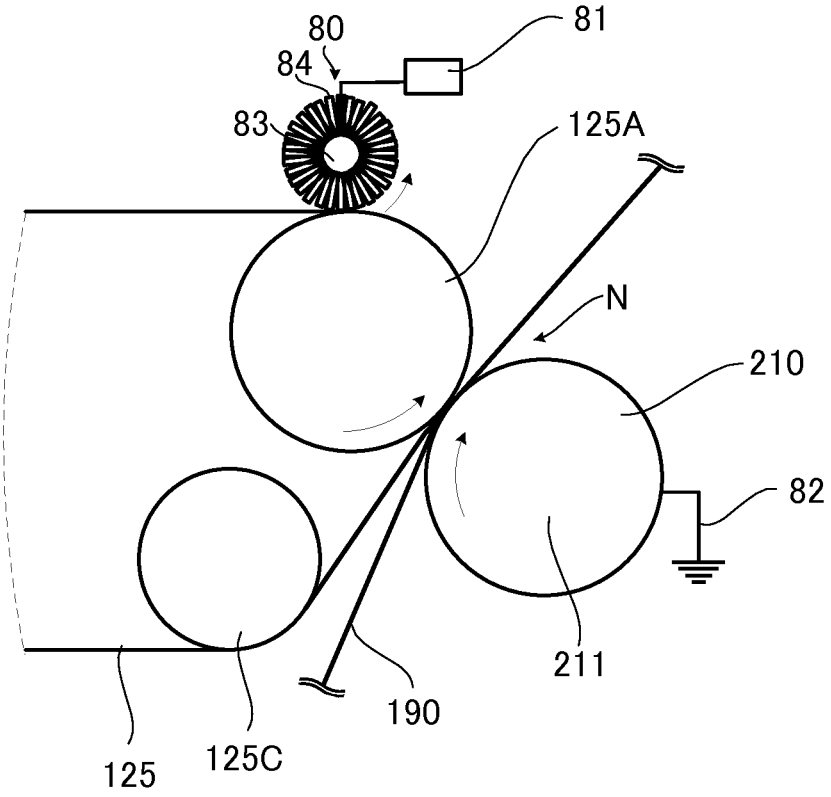
FIG. 7 is a side cross-sectional view showing the structure of a brush section of an image forming apparatus according to a modification.

(2) Although in the above embodiment a description has been given of the case where the brush section 80 is a stationary brush, the present invention is not necessarily limited to this case. As shown in FIG. 7, the brush section 80 used may be a rotating brush which includes a rotary shaft 83 extending in the same direction as the direction along the rotary shaft of the drive roller 125A and in which brush bristles 84 are implanted in the rotary shaft 83. Furthermore, the rotating brush may be driven into forward or reverse rotation relative to the direction of travel of the intermediate transfer belt 125. Also in the case where such a configuration is employed, the similar effects to the cleaning effect and the effect of separating a recording paper sheet P as described in the above embodiment can be achieved. In addition, the effect can also be achieved of making the intermediate transfer belt 125 difficult to wear.

(3) The image forming apparatus may be provided with, in addition to the brush section 80, the power supply device 81, and the ground portion 82, a separating needle configured to attract the recording paper sheet P using charges of opposite polarity to that of electrified charges on the recording paper sheet P to thus separate the recording paper sheet P. In the case where such a configuration is employed, the recording paper sheet P can be separated very well.

CONCLUSION

As thus far described, in the image forming apparatuses 1 according to the above embodiment and modification, the brush section (charging member) 80 is disposed at a location downstream of the secondary transfer roller (transfer roller) 210 in the direction of travel of the intermediate transfer belt 125 and facing the drive roller 125A with the intermediate transfer belt 125 in between and residual toner remaining on the outer peripheral surface of the intermediate transfer belt 125 is charged to a normal charge polarity. Furthermore, the cleaning device (cleaning section) 70 is disposed downstream of the brush section 80 in the direction of travel of the intermediate transfer belt 125 and configured to electrically attract residual toner remaining on the outer peripheral surface of the intermediate transfer belt 125 to collect the residual toner. Moreover, the power supply device 81 and the ground portion 82 (potential difference applying section) are configured to apply a potential difference between the brush section 80 and the secondary transfer roller 210 to generate an electric current flowing from the brush section 80 through the drive roller 125A to the secondary transfer roller 210 and having the same polarity as the normal charge polarity.

In the above configuration, since a bias having the same polarity as the normal charge polarity is applied from the power supply device 81 to the brush section 80, residual toner at a location facing the brush section 80 is given charges of the same polarity as the normal charge polarity and thus charged to the normal charge polarity. Thus, the electrified charges on the residual toner can be made uniform to increase the collectability of the residual toner in the cleaning device 70. Furthermore, owing to an electric current flowing from the brush section 80 through the drive roller 125A to the secondary transfer roller 210 and having the same polarity as the normal charge polarity, charges of the same polarity as the normal charge polarity can be applied to residual toner located on the intermediate transfer belt 125 between the brush section 80 and the secondary transfer roller 210. Thus, the surface of the intermediate transfer belt 125 carrying the residual toner is charged to the same polarity as the normal charge polarity, so that an electrostatic repulsion occurs between the recording paper sheet P and the intermediate transfer belt 125. As a result, the recording paper sheet P can be separated well from the intermediate transfer belt 125.

The cleaning effect and the effect of separating a recording paper sheet P as described above can be achieved by providing the brush section 80, the power supply device 81, and the ground portion 82. Therefore, the above configuration can, with a simple structure, sufficiently collect residual toner remaining on the outer peripheral surface of the intermediate transfer belt and separate the recording paper sheet from the intermediate transfer belt.

The invention claimed is:

1. An image forming apparatus comprising:

an image forming section including a photosensitive drum and configured to form a toner image on the photosensitive drum;

an intermediate transfer belt mounted around a drive roller and a driven roller and configured to travel in an endless path between the drive roller and the driven roller;

a primary transfer roller disposed at a location facing the photosensitive drum with the intermediate transfer belt in between and configured to transfer the toner image formed on the photosensitive drum to an outer peripheral surface of the intermediate transfer belt;

a secondary transfer roller disposed at a location facing the drive roller with the intermediate transfer belt in between and configured to transfer the toner image formed, at a nip between the secondary transfer roller and the drive roller, on the outer peripheral surface of the intermediate transfer belt to a recording paper sheet;

a charging member disposed at a location downstream of the secondary transfer roller in a direction of travel of the intermediate transfer belt and facing the drive roller with the intermediate transfer belt in between, the charging member being configured to charge residual toner remaining on the outer peripheral surface of the intermediate transfer belt to a normal charge polarity;

a cleaning section including a fur brush disposed at a location downstream of the charging member in the direction of travel of the intermediate transfer belt and facing the driven roller with the intermediate transfer belt in between, the fur brush being in contact with the outer peripheral surface of the intermediate transfer belt and configured to electrically attract the residual toner remaining on the outer peripheral surface of the intermediate transfer belt to collect the residual toner; and a potential difference applying section including a power supply device configured to apply a bias to either one of the charging member and the secondary transfer roller and a ground portion configured to ground the other of the charging member and the secondary transfer roller, the potential difference applying section being configured to apply a potential difference between the charging member and the secondary transfer roller to generate an electric current flowing from the charging member through the drive roller to the secondary transfer roller and having the same polarity as the normal charge polarity.

2. The image forming apparatus according to claim 1, wherein the charging member is a brush.

3. The image forming apparatus according to claim 2, wherein the brush is a rotating brush which includes a rotary shaft extending in the same direction as a direction along a rotary shaft of the drive roller and in which brush bristles are implanted in the rotary shaft.

4. The image forming apparatus according to claim 3, wherein the rotating brush is capable of being driven into forward or reverse rotation relative to the direction of travel of the intermediate transfer belt.

* * * * *